US005863640A

United States Patent [19]

Ljungberg et al.

[11] Patent Number: 5,863,640

[45] **Date of Patent: *Jan. 26, 1999**

[54] COATED CUTTING INSERT AND METHOD OF MANUFACTURE THEREOF

[75] Inventors: Björn Ljungberg, Enskede; Leif Åkesson, Älvsjö, both of Sweden

[73] Assignee: Sandvik AB, Sandviken, Sweden

[ * ] Notice: The term of this patent shall not extend beyond the expiration date of Pat. No. 5,487,625.

[21] Appl. No.: 675,034

[22] Filed: Jul. 3, 1996

[30] Foreign Application Priority Data

Jul. 14, 1995 [SE] Sweden ..... 9502640

[51] Int. Cl.[6] ..... B32B 9/00

[52] U.S. Cl. ..... 428/216; 51/307; 51/309; 428/212; 428/336; 428/457; 428/469; 428/697; 428/698; 428/701; 428/702; 427/348; 427/376.2; 427/419.3; 407/119

[58] Field of Search ..... 51/307, 309; 428/212, 428/216, 336, 457, 464, 697, 698, 701, 702; 407/119; 427/348, 376.2, 419.3, 255

[56] References Cited

U.S. PATENT DOCUMENTS

| | | | |
|---|---|---|---|
| 4,180,400 | 12/1979 | Smith et al. | 428/469 |
| 4,610,931 | 9/1986 | Nemeth . | |
| 4,619,866 | 10/1986 | Smith et al. | 428/698 |
| 5,071,696 | 12/1991 | Chatfield et al. | 428/698 |
| 5,137,774 | 8/1992 | Ruppi | 428/702 |
| 5,162,147 | 11/1992 | Ruppi | 428/216 |
| 5,487,625 | 1/1996 | Ljunghers et al. | 407/119 |
| 5,543,176 | 8/1996 | Chatfield et al. | 428/701 |
| 5,545,490 | 8/1996 | Oshika | 428/701 |
| 5,635,247 | 6/1997 | Ruppi | 427/348 |
| 5,652,045 | 7/1997 | Nakamura et al. | 57/307 |

FOREIGN PATENT DOCUMENTS

| | | |
|---|---|---|
| 0408535 A1 | 1/1991 | European Pat. Off. . |
| 0594875 A1 | 5/1994 | European Pat. Off. . |
| 0600115 A | 6/1994 | European Pat. Off. . |
| 0685572 A | 12/1995 | European Pat. Off. . |
| 0709484 A | 5/1996 | European Pat. Off. . |
| 0736615 A | 10/1996 | European Pat. Off. . |
| 60-08008 | 1/1994 | Japan . |
| 6-108254 | 4/1994 | Japan . |
| 501527 | 3/1995 | Sweden . |
| 502174 | 9/1995 | Sweden . |
| 502223 | 9/1995 | Sweden . |

*Primary Examiner*—Archene Turner
*Attorney, Agent, or Firm*—Burns, Doane, Swecker & Mathis

[57] ABSTRACT

A coated cutting insert particularly useful for intermittent cutting of low alloyed steel. The insert is characterized by a WC-Co-based cemented carbide body having a highly W-alloyed Co-binder phase and a coating including an inner layer of $TiC_xN_yO_z$ with columnar grains and an outer coating of a fine grained, textured $\alpha$-$Al_2O_3$-layer.

20 Claims, 1 Drawing Sheet

COATED CUTTING INSERT AND METHOD OF MANUFACTURE THEREOF

FIELD OF THE INVENTION

The present invention relates to a coated cutting tool (cemented carbide insert) particularly useful for intermittent cutting of low alloyed steel.

BACKGROUND OF THE INVENTION

Low alloyed steel is a material which, in general, is difficult to machine with coated or uncoated cemented carbide tools. Smearing of workpiece material onto the cutting edge and flaking of the coating often occur. The cutting condition is particularly difficult when intermittent machining is employed under wet conditions (using coolant).

When machining low alloyed steels with coated cemented carbide tools, the cutting edge is worn by chemical wear, abrasive wear and by so-called "adhesive" wear. The adhesive wear is often the tool life limiting wear. Adhesive wear occurs when fragments or individual grains of the coating possibly followed by parts of the cemented carbide are successively pulled away from the cutting edge by the workpiece chip as it is formed. Further, when wet cutting is employed the wear may also be accelerated by an additional wear mechanism. For instance, coolant and workpiece material may penetrate into the cooling cracks of the coatings. This penetration often leads to a chemical reaction between workpiece material and coolant with the cemented carbide. The Co-binder phase may oxidize in a zone near the crack and along the interface between the coating and the cemented carbide. In time, coating fragments are lost piece by piece.

SUMMARY OF THE INVENTION

An object of the invention is to overcome disadvantages and drawbacks associated with prior art coated cutting tools.

According to the invention, it has surprisingly been found that an excellent tool for cutting low alloy steel can be provided by coating a cemented carbide body having a highly W-alloyed binder phase with layers including a columnar $TiC_xN_yO_z$-layer and a textured $\alpha$-$Al_2O_3$-layer, and the coating surface can be treated by wet-blasting or by brushing.

DETAILED DESCRIPTION OF THE PREFERRED EMBODIMENTS

Figure 1:
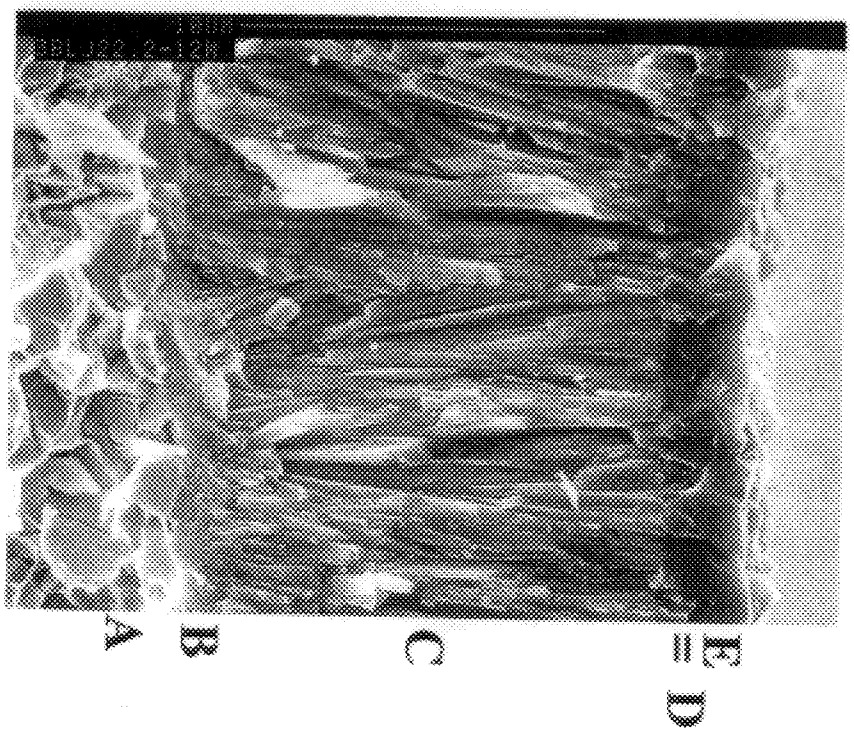
FIG. 1 is a micrograph at 5000× magnification of a coated insert according to the present invention in which A represents a cemented carbide body, B represents a $TiC_xN_yO_z$-layer with equiaxed grains, C represents a $TiC_xN_yO_z$-layer with columnar grains, D represents a $TiC_xN_yO_z$-layer with equiaxed or needle-like grains, and E represents a textured $\alpha$-$Al_2O_3$-layer with fine grains.

According to the present invention, a cutting tool insert is provided with a cemented carbide body of a composition, in weight %, 5–11% Co, preferably 5–8% Co, <10%, preferably 1.5–7.5%, cubic carbides of the metals Ti, Ta and/or Nb and balance WC. The grain size of the WC is in the range of about 1–3 $\mu$m, preferably about 2 $\mu$m. The cobalt binder phase is highly alloyed with W. The content of W in the binder phase can be expressed as the CW-ratio, wherein:

$$\text{CW-ratio}=M_s/(\%\ \text{Co})\times(0.0161)$$

In the above relationship, $M_s$ is the measured saturation magnetization of the cemented carbide body and % Co is the weight percentage of Co in the cemented carbide. Thus, the CW-ratio is a function of the W content in the Co binder phase. A low CW-ratio corresponds to a high W-content in the binder phase.

It has now been found according to the invention that improved cutting performance is achieved if the cemented carbide body has a CW-ratio of 0.76–0.93, preferably 0.80–0.90. The cemented carbide body may contain small amounts, e.g., <1 volume %, of eta phase ($M_6C$), without any detrimental effect. In a preferred embodiment, a thin (e.g., about 15–35 $\mu$m) surface zone depleted of cubic carbides and often enriched in binder phase can be present according to prior art such as disclosed in U.S. Pat. No. 4,610,931. In this case, the cemented carbide may contain carbonitride or even nitride.

The coating comprises various layers such as titanium carbonitride and alumina layers. In a preferred embodiment, the coating includes the following:

- a first (innermost) layer of $TiC_xN_yO_z$ with x+y+z=1, preferably z<0.5, with a thickness of 0.1–2 $\mu$m, and with equiaxed grains with size <0.5 $\mu$m;
- a second layer of $TiC_xN_yO_z$ with x+y+z=1, preferably with z=0 and x>0.3 and y>0.3, with a thickness of 2–15 $\mu$m, preferably 5–8 $\mu$m, with columnar grains having a diameter of about <5 $\mu$m, preferably <2 $\mu$m;
- a third layer of $TiC_xN_yO_z$ with x+y+z=1 with $z\leqq 0.5$, preferably z>0.1, with a thickness of 0.1–2 $\mu$m and with equiaxed or needle-like grains with size $\leqq 0.5$ $\mu$m, this layer being the same as or different from the innermost layer; and
- a fourth layer of a smooth, textured, fine-grained (grain size about 0.5–2 $\mu$m) $\alpha$-$Al_2O_3$-layer with a thickness of 2–10 $\mu$m, preferably 3–6 $\mu$m, and a surface roughness $R_{max}\leqq 0.4$ $\mu$m over a length of 10 $\mu$m. Preferably, this $Al_2O_3$-layer is the outermost layer but it may also be followed by further layers such as a thin (about 0.1–1 $\mu$m) decorative layer of a material such as TiN.

In addition, the $\alpha$-$Al_2O_3$-layer has a preferred crystal growth orientation in either the (104)-, (012)- or (110)-direction, preferably in the (012)-direction, as determined by X-ray Diffraction (XRD) measurements. A Texture Coefficient, TC, can be defined as:

$$TC(hkl)=\frac{I(hkl)}{I_0(hkl)}\left\{\frac{1}{n}\Sigma\frac{I(hkl)}{I_0(hkl)}\right\}^{-1}$$

where

I(hkl)=measured intensity of the (hkl) reflection;

Io(hkl)=standard intensity of the ASTM standard powder pattern diffraction data; and n=number of reflections used in the calculation, (hkl) reflections used are: (012), (104), (110), (113), (024), (116).

According to the invention, TC for the set of (012), (104) or (110) crystal planes is larger than 1.3, preferably larger than 1.5.

According to the method of the invention, a WC-Co-based cemented carbide body having a highly W-alloyed binder phase with a CW-ratio as set forth above is coated with:

- a first (innermost) layer of $TiC_xN_yO_z$ with x+y+z=1, preferably z<0.5, with a thickness of 0.1–2 $\mu$m, and with equiaxed grains with size <0.5 μm using known CVD-methods;

a second layer of $TiC_xN_yO_z$ x+y+z=1, preferably with z=0 and x>0.3 and y>0.3, with a thickness of 2–15 μm, preferably 5–8 μm, with columnar grains and with a diameter of about <5 μm, preferably <2 μm, deposited preferably by MTCVD-technique (using acetonitrile as the carbon and nitrogen source for forming the layer in the temperature range of 700°–900° C.). The exact conditions, however, depend to a certain extent on the design of the equipment used;

a third layer of $TiC_xN_yO_z$, x+y+z=1 with z≦0.5, preferably z>0.1, with a thickness of 0.1–2 μm and with equiaxed or needle-like grains with size <0.5 μm, using known CVD-methods, this layer being the same as or different from the innermost layer; and a fourth (outer) layer of a smooth textured α-$Al_2O_3$-layer according to Swedish Patent No. 501527 or Swedish Patent Application Nos. 9304283-6 or 9400089-0 with a thickness of 2–10 μm, preferably 3–6 μm, and a surface roughness $R_{max}$≦0.4 μm over a length of 10 μm. The smooth coating surface can be obtained by a gentle wet-blasting of the coating surface with fine grained (400–150 mesh) alumina powder or by brushing the edges with brushes based on a material such as SiC, as disclosed in Swedish Patent Application No. 9402543-4 corresponding to U.S. patent application Ser. No. 08/497,934, filed Jun. 5, 1995, the subject matter of which is hereby incorporated by reference.

When a $TiC_xN_yO_z$-layer with z>0 is desired, $CO_2$ and/or CO are/is added to the reaction gas mixture.

The invention is now described with reference to the following non-limiting examples which are given solely for purposes of illustrating embodiments of the invention.

EXAMPLE 1

Sample A. Cemented carbide cutting tool inserts of style CNMG 120408-SM with the composition 7.5 wt. % Co, 1.8 wt. % TiC, 0.5 wt. % TiN, 3.0 wt. % TaC, 0.4 wt. % NbC and balance WC with a binder phase highly alloyed with W corresponding to a CW-ratio of 0.88 were coated with a 0.5 μm equiaxed TiCN-layer followed by a 7 μm thick TiCN-layer with columnar grains by using the MTCVD-technique (process temperature 850° C. and $CH_3CN$ as the carbon/nitrogen source). In subsequent process steps during the same coating cycle, a 1 μm thick layer of $TiC_xN_yO_z$ (about x=0.6, y=0.2 and z=0.2) with equiaxed grains was deposited followed by a 4 μm thick layer of (012)-textured α-$Al_2O_3$ deposited according to conditions given in Swedish Patent No. 501527. XRD-measurement showed a texture coefficient TC(012) of 1.6 for the α-$Al_2O_3$-layer. The cemented carbide body had a surface zone about 25 μm thick, depleted from cubic carbides.

Sample B. Cemented carbide cutting tool inserts of style CNMG 120408-SM from the same batch as in Sample A were coated with a 0.5 μm equiaxed TiCN-layer followed by a 7 μm thick TiCN-layer with columnar grains by using the MTCVD-technique (process temperature 850° C. and $CH_3CN$ as the carbon/nitrogen source). In subsequent process steps during the same coating cycle, a 1 μm thick layer of $TiC_xN_yO_z$ (about x=0.6, y=0.2 and z=0.2) with equiaxed grains was deposited followed by a 4 μm thick layer of (104)-textured α-$Al_2O_3$-layer deposited according to conditions given in Swedish Patent Application No. 9400089-0. XRD-measurement showed a texture coefficient TC(104) of 1.7 for the α-$Al_2O_3$-layer.

Sample C. Cemented carbide cutting tool inserts of style CNMG 120408-SM with the composition 6.5 wt. % Co and 8.8 wt. % cubic carbides (3.3 wt. % TiC, 3.4 wt. % TaC and 2.1 wt. % NbC) and balance WC were coated under the procedure given in Sample A. The cemented carbide body had a CW-ratio of 1.0 and XRD-measurement showed a texture coefficient TC(012) of 1.5 for the α-$Al_2O_3$-layer.

Sample D. Cemented carbide cutting tool inserts of style CNMG 120408-SM from the same batch as in Sample A were coated with a 6 μm equiaxed layer of TiCN followed by a 4 μm thick layer of $Al_2O_3$-layer according to prior art technique. XRD-analysis showed that the $Al_2O_3$-layer consisted of a mixture of α and κ-$Al_2O_3$, approximately in the ratio 30/70.

Sample E. Cemented carbide cutting tool inserts from the same batch as in Sample C were coated according to the procedure given in Sample D. XRD-analysis showed that the $Al_2O_3$-layer consisted of a mixture of oa and κ-$Al_2O_3$ in a ratio of about 20/80.

Before performing the following cutting tests, all inserts from Samples A–E were wet blasted using an alumina-water slurry in order to smooth the coating surfaces. The inserts were tested in an intermittent longitudinal turning operation. The workpiece material was a low alloyed low carbon steel (SCr420H) in the shape of a 22 mm thick ring with an outer diameter of 190 mm and an inner diameter of 30 mm. Each longitudinal passage over the ring thickness consisted of 22 in-cuts of one mm each. The number of passages over the ring thickness until flaking occurred was recorded for each variant as set forth in Table 1.

TABLE 1

| Sample | Treatment | Number of passages before edge flaking |
|---|---|---|
| A | highly W-alloyed cemented carbide body columnar coating/(012)-textured α-$Al_2O_3$ (invention) | 165 |
| B | highly W-alloyed cemented carbide body columnar coatingl(104)-textured α-$Al_2O_3$ (invention) | 117 |
| C | low W-alloyed cemented carbide body columnar coating/(012)-textured α-$Al_2O_3$ (comparative) | 60 |
| D | highly W-alloyed cemented carbide body equiaxed coating/α+ κ − $Al_2O_3$ (comparative) | 15 |
| E | low W-alloyed cemented carbide body equiaxed coating/α+ κ − $Al_2O_3$ (comparative) | 15 |

EXAMPLE 2

Sample F. Cemented carbide cutting tool inserts of style CNMG 120408-QM with the composition 7.5 wt. % Co, 2.3 wt. % TiC, 3.0 wt. % TaC, 0.4 wt. % NbC and balance WC and a binder phase highly alloyed with W corresponding to a CW-ratio of 0.83 were coated with a 0.5 μm equiaxed TiCN-layer followed by a 7 μm thick TiCN-layer with columnar grains by using the MTCVD-technique (process temperature 850° C. and $CH_3CN$ as the carbon/nitrogen source). In subsequent process steps during the same coating cycle, a 1 μm thick layer with equiaxed grains of $TiC_xN_yO_z$ (about x=0.6, y=0.2 and z=0.2) was deposited followed by a 4 μm thick layer of (012)-textured α-$Al_2O_3$ deposited according to conditions given in Swedish Patent No. 501527. In contrast to the inserts of Sample A, the cemented carbide body according to Sample F did not have any depleted zone of cubic carbides near the surface. XRD-measurement showed a texture coefficient TC(012) of 1.5 of the $\alpha$-$Al_2O_3$-layer.

Sample G. Cemented carbide cutting tool inserts of style CNMG 120408-QM with the composition 5.5 wt. % Co and 8.4 wt. % cubic carbides (2.6 wt. % TiC, 3.5 wt. % TaC and 2.3 wt. % NbC) and balance WC were coated according to the procedure given in Sample D. The cemented carbide body had a CW-ratio of 0.98. XRD-analysis showed that the $Al_2O_3$-layer consisted of a mixture of $\alpha$ and $\kappa$-$Al_2O_3$ in an approximate ratio of 25/75.

Sample H. Cemented carbide cutting tool inserts from the same batch as in Sample G were coated under the procedure given in Sample A. XRD-measurement showed a texture coefficient TC(012) of 1.6.

Inserts from Samples F–H were brushed in order to smooth the coating surface along the cutting edge and tested according to the method used to test Samples A–E. The results of the test on Samples F–H are set forth in Table 2.

TABLE 2

| Sample | Variant | Number of passages before edge flaking |
|---|---|---|
| F | highly W-alloyed cemented carbide body columnar coating (012)-textured $\alpha$-$Al_2O_3$ (invention) | 150 |
| G | highly W-alloyed cemented carbide body equiaxed coating/$\alpha + \kappa - Al_2O_3$ (comparative) | 15 |
| H | low W-alloyed cemented carbide body columnar coating/(012)-textured $\alpha$-$Al_2O_3$ (comparative) | 60 |

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A cutting tool insert for machining of low alloyed steel, the insert comprising a cemented carbide body and a coating wherein said cemented carbide body consists essentially of, in weight %, WC, 5–11% Co and 0–10% cubic carbides of metals from groups IVb, Vb or VIb of the periodic table and a highly W-alloyed binder phase with a CW-ratio of 0.76–0.93 and said coating comprises a first layer of $TiC_xN_yO_z$ having a thickness of 0.1–2 $\mu$m and equiaxed grains <0.5 $\mu$m in size, a second layer of $TiC_xN_yO_z$ having a thickness of 2–15 $\mu$m and columnar grains of about <5 $\mu$m in diameter, a third layer of $TiC_xN_yO_z$ having a thickness of 0.1–2 $\mu$m and equiaxed or needle-like grains $\leqq$0.5 $\mu$m in size, and a fourth layer of a smooth, textured, fine-grained $\alpha$-$Al_2O_3$-layer with a thickness of 2–10 $\mu$m and grain size of 0.5–2 $\mu$m.

2. The cutting insert according to claim 1, wherein the $\alpha$-$Al_2O_3$-layer has a texture in the (012)-direction and a texture coefficient TC(012) larger than 1.3.

3. The cutting insert according to claim 1, wherein the $\alpha$-$Al_2O_3$-layer has a texture in the (104)-direction and a texture coefficient TC(104) larger than 1.3.

4. The cutting insert according to claim 1, wherein the $\alpha$-$Al_2O_3$-layer has a texture in the (110)-direction and a texture coefficient TC(110) larger than 1.3.

5. The cutting insert according to claim 1, further comprising an outermost coating of a thin 0.1–1 $\mu$m TiN-layer.

6. The cutting insert according to claim 1, wherein the second layer has a thickness of 5–8 $\mu$m and columnar grains of about <2 $\mu$m in diameter.

7. The cutting insert according to claim 1, wherein the fourth layer has a thickness of 3–6 $\mu$m.

8. The cutting insert according to claim 1, wherein the cemented carbide body includes 5–8 wt. % Co and 1.5–7.5 wt. % cubic carbides.

9. The cutting insert according to claim 1, wherein the CW-ratio is 0.80–0.90.

10. A method of coating a cutting insert comprising a WC-Co-based cemented carbide body, the method comprising:

coating the body with a first layer of $TiC_xN_yO_z$ in a thickness of 0.1–2 $\mu$m, and such that the first layer comprises equiaxed grains <0.5 $\mu$m in size;

coating the first layer with a second layer of $TiC_xN_yO_z$ in a thickness of 2–15 $\mu$m and such that the second layer has columnar grains with a diameter of about <5 $\mu$m, the second layer being deposited at a temperature of 850°–900° C. while using acetonitrile as the carbon and nitrogen source;

coating the second layer with a third layer of $TiC_xN_yO_z$ in a thickness of 0.1–2 $\mu$m and such that the third layer has equiaxed or needle-like grains $\leqq$0.5 $\mu$m in size; and coating the third layer with a fourth layer of a smooth textured $\alpha$-$Al_2O_3$-layer textured in the direction (012), (104) or (110) with a thickness of 2–10 $\mu$m.

11. The method according to claim 10, wherein the $\alpha$-$Al_2O_3$-layer has a texture in the (012)-direction and a texture coefficient TC(012) larger than 1.3.

12. The method according to claim 10, wherein the $\alpha$-$Al_2O_3$-layer has a texture in the (104)-direction and a texture coefficient TC(104) larger than 1.3.

13. The method according to claim 10, wherein the $\alpha$-$Al_2O_3$-layer has a texture in the (110)-direction and a texture coefficient TC(110) larger than 1.3.

14. The method according to claim 10, further comprising coating the fourth layer with an outermost coating of a thin 0.1–1 $\mu$m TiN-layer.

15. The method according to claim 10, wherein the second layer has a thickness of 5–8 $\mu$m and columnar grains of about <2 $\mu$m in diameter.

16. The method according to claim 10, wherein the fourth layer has a thickness of 3–6 $\mu$m.

17. The method according to claim 10, wherein the cemented carbide body includes WC, 5–8 wt. % Co and 1.5–7.5 wt. % cubic carbides.

18. The method according to claim 10, wherein the CW-ratio is 0.80–0.90.

19. The method according to claim 10, wherein the cemented carbide body consists essentially of, in weight %, WC, 5–11% Co and 0–10% cubic carbides of metals from groups IVb, Vb or VIb of the periodic table and a highly W-alloyed binder phase with a CW-ratio of 0.76–0.93.

20. A cutting tool insert for machining of low alloyed steel, the insert comprising a cemented carbide body and a coating, the body comprising a WC-Co-based cemented carbide body and said coating comprising a first layer of $TiC_xN_yO_z$ having a thickness of 0.1–2 $\mu$m and equiaxed grains <0.5 $\mu$m in size, a second layer of $TiC_xN_yO_z$ having a thickness of 2–15 $\mu$m and columnar grains of about <5 $\mu$m in diameter, a third layer of $TiC_xN_yO_z$ having a thickness of 0.1–2 $\mu$m and equiaxed or needle-like grains $\leqq$0.5 $\mu$m in size, and a fourth layer of a smooth, textured, fine-grained $\alpha$-$Al_2O_3$-layer with a thickness of 2–10 $\mu$m and grain size of 0.5–2 $\mu$m.

* * * * *

UNITED STATES PATENT AND TRADEMARK OFFICE

CERTIFICATE OF CORRECTION

PATENT NO. : 5,863,640
APPLICATION NO. : 08/675034
DATED : January 26, 1999
INVENTOR(S) : Bjorn Ljungberg et al.

It is certified that error appears in the above-identified patent and that said Letters Patent is hereby corrected as shown below:

Column 2, line 1: "CW-ratio=$M_s$/(wt % Co)×(0.0161)" should read --CW-ratio = $M_s$/[(wt % Co)×(0.0161)]--.

Signed and Sealed this

Ninth Day of September, 2008

JON W. DUDAS
*Director of the United States Patent and Trademark Office*